US005327966A

United States Patent [19]

Reimert

[11] Patent Number: 5,327,966

[45] Date of Patent: Jul. 12, 1994

[54] WELLHEAD EQUIPMENT

[75] Inventor: Larry E. Reimert, Houston, Tex.

[73] Assignee: Dril-Quip, Inc., Houston, Tex.

[21] Appl. No.: 67,749

[22] Filed: May 26, 1993

[51] Int. Cl.[5] ..... E21B 33/04

[52] U.S. Cl. ..... 166/208; 285/140; 285/143

[58] Field of Search ..... 166/208, 86, 88, 89; 285/140, 143

[56] References Cited

U.S. PATENT DOCUMENTS

| | | | |
|---|---|---|---|
| 4,455,040 | 6/1984 | Shinn | 285/142 |
| 4,460,042 | 7/1984 | Galle, Jr. | 166/217 |
| 4,515,400 | 5/1985 | Smith et al. | 285/141 |
| 4,577,686 | 3/1986 | Milberger et al. | 166/208 |
| 4,757,860 | 7/1988 | Reimert | 166/208 |
| 4,773,477 | 9/1988 | Putch | 166/206 |
| 4,811,784 | 3/1989 | Theiss | 166/208 |
| 4,826,216 | 5/1989 | Hynes et al. | 285/140 |
| 4,842,307 | 6/1989 | Sweeney et al. | 285/140 |
| 4,919,460 | 4/1990 | Milberger et al. | 285/141 |
| 5,209,521 | 5/1993 | Osborne | 285/3 |

*Primary Examiner*—Hoang C. Dang
*Attorney, Agent, or Firm*—Vaden, Eickenroht, Thompson, Boulware & Feather

[57] ABSTRACT

Subsea wellhead equipment is disclosed as comprising a housing including a main body of a first material having an internal cavity thereabout and a weld body of a material having a considerably greater yield strength than that of the main body formed integrally with the main body within the cavity to provide an upwardly facing seat in the housing bore, and a hanger including a main body and a ring of a material having a considerably greater yield strength than that of the main body and carried by the main body in a position to provide a downwardly facing shoulder engageable with the seat to support the load of the hanger therefrom.

12 Claims, 1 Drawing Sheet

FIG. 1
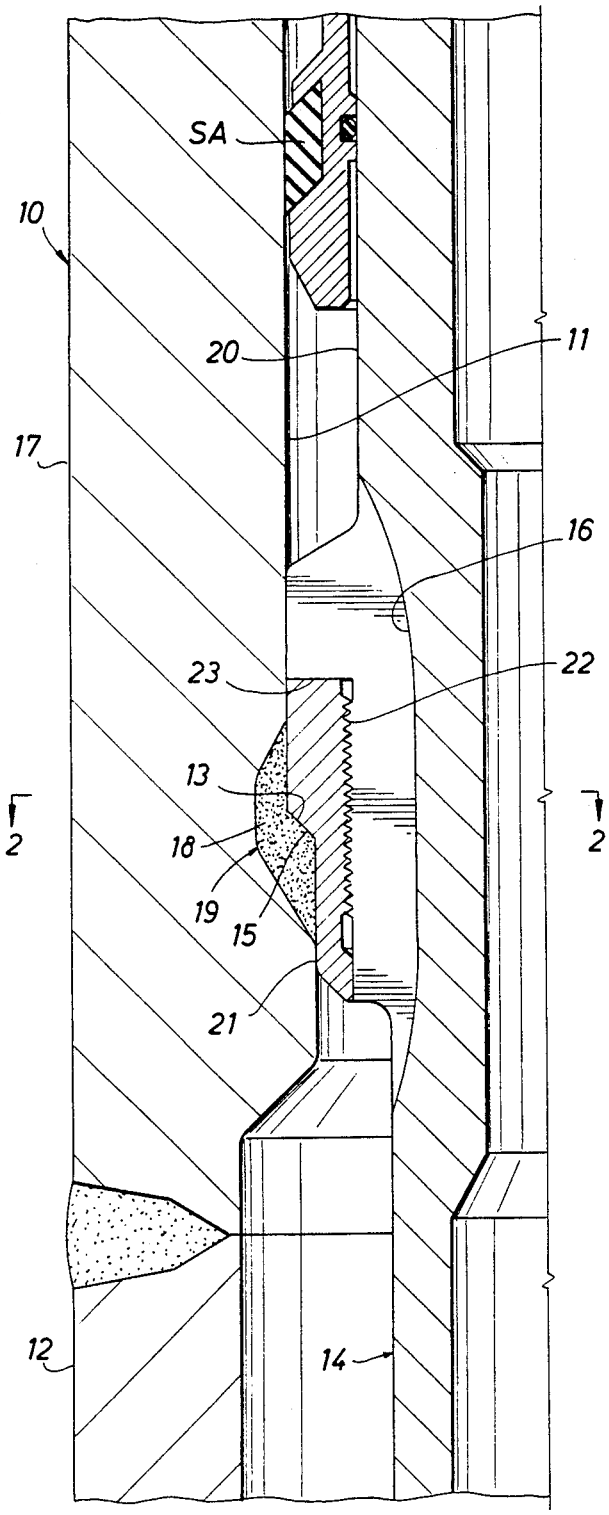
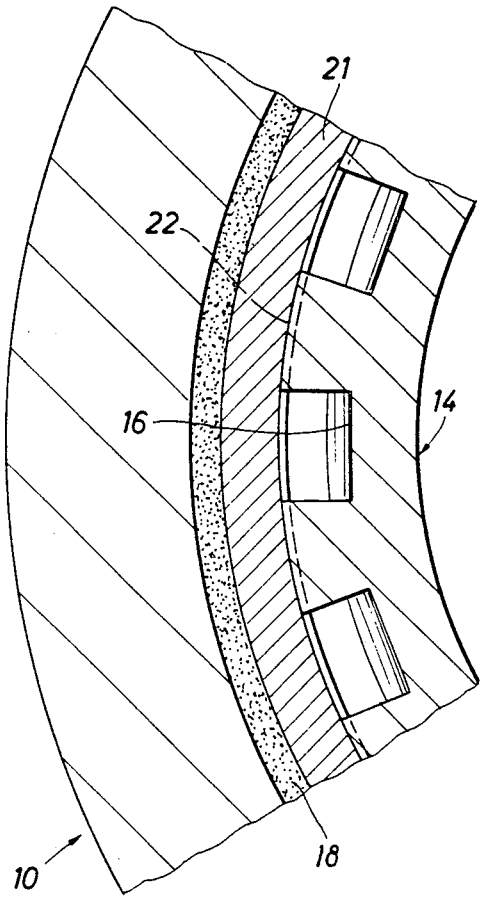
FIG. 2

WELLHEAD EQUIPMENT

This invention relates in general to wellhead equipment of the type wherein a tubular hanger connectible to the upper end of a pipe string has a shoulder thereabout for landing on a seat about the bore of a wellhead housing disposable at the upper end of the well so as to suspend the pipe string within the well as the hanger is lowered into the bore. More particularly, it relates to improvements in equipment of this type wherein the seat and shoulder are of such construction that their load surfaces occupy the least possible annular space between the hanger and housing bore, so that, in the drilling and completion of a well of this type, it is possible to land the hanger for a pipe string of required diameter within the bore of a housing of the largest possible size. In one of its aspects, this invention relates to subsea wellhead equipment of this type wherein a hanger is connected to the upper end of the inner casing for landing on a seat within the bore of a wellhead housing connected to the upper end of an outer casing of a subsea well.

Toward this end, it was proposed in each of U.S. Pat. Nos. 4,460,042 and 4,757,860 to provide the hanger with multiple load shoulders for landing respectively on multiple seats in the bore of the housing. However, in the interest of reducing the cost of fabrication of the housing and hanger, U.S. Pat. No. 4,826,216 proposed wellhead equipment in which portions of the housing and hanger which form the seat and shoulder of materials have considerably higher yield strengths than that of the remainder of the housing and hanger. Consequently, the cross-sectional areas of the load surfaces, and thus the annular space between the hanger and bore, may be proportionately less than would be required if the seat and shoulder were instead formed on the main portions of the hanger and housing made of a metal with less yield strength.

Conventionally, the housing and hanger are made of a low alloy, carbon steel which, when of high yield strength, are susceptible to damage by $H_2S$ which is often present in the well fluid from lower depths of the well. However, the load surfaces of the hanger and housing are protected therefrom by seal assemblies which conventionally close off the annular space between the hanger and bore above the longitudinal passageways conventionally formed in the hanger to permit drilling fluids to be circulated through the annular space before activation of the seal assemblies.

However, in the equipment of the aforementioned patent, as well as by at least one other manufacturer other than the assignee of that patent, the load surfaces are formed on fabricated rings of the high yield strength material, the ring forming the seat being mounted in a recess about the bore of the housing and the ring forming the shoulder being threaded about or otherwise mounted on the main body portion so as to support the main portion therefrom. The need for fabricating these rings, as well as the housing, necessarily increases the cost of manufacturing such equipment, and it is therefore the object of this invention to provide wellhead equipment of this type in which the seat on the bore of the housing is formed in a less expensive manner.

This and other objects are accomplished, in accordance with the illustrated embodiment of the present invention, by wellhead equipment of the type described wherein the housing includes a main body of a first material having an internal cavity thereabout and a weld body of a second material having a considerably greater yield strength than that of the first formed integrally with the main body within the cavity to provide an upwardly facing seat in the housing bore, and the hanger includes a main body of a first material and a ring of a second material having a considerably greater yield strength than that of the first material and carried by the main body in position to provide a downwardly facing shoulder engageable with the seat to support the hanger therefrom.

The cross-sectional area of the weld body supported by the main body of the housing bears substantially the same ratio to that of the seat as does the yield strength of the weld body to that of the main body of the housing, and the cross-sectional area of the main body supported by the ring bears substantially the same ratio to that of the shoulder as does the yield strength of the ring to that of the main body. As illustrated, the ring is threadedly connected to the main body of the hanger to contribute to the area supporting the main body. More particularly, the yield strengths of the main bodies of the housing and hanger are essentially equal, and the yield strengths of the weld body and ring are essentially equal, with the yield strength of the main portion of the housing being about 75,000 psi to provide resistance to damage by $H_2S$, and the yield strengths of the weld body and shoulder ring being on the order of about 150,000 psi.

In the preferred and illustrated embodiment of the invention, the wellhead equipment is installed on a subsea well, wherein the housing is adapted to be mounted on the upper end of an outer casing string, and the hanger is connectible to the upper end of an inner casing string for suspending within the outer string. In the use of such equipment, wherein cement returns are circulated through passageways formed in the hanger, a means is also provided for closing off the annular space between the housing bore and hanger so as to protect the load surfaces from $H_2S$ produced with well fluid through the inner casing string.

In the drawings, wherein like reference characters are used throughout to designate like parts:

FIG. 1 is a half vertical sectional view of subsea wellhead equipment constructed in accordance with the present invention; and FIG. 2 is a cross-sectional view of the equipment of FIG. 1, as seen along broken lines 2—2 of FIG. 1.

With reference now to the details of the above described drawings, the wellhead equipment is shown to comprise a housing 10 mounted on the upper end of an outer casing string 12 extending within the well bore and having a bore 11 therethrough forming an upward continuation of the casing string, and an upwardly facing seat 13 which is formed in the bore in a manner to be described more fully hereinafter. The wellhead equipment further includes a tubular hanger 14 adapted to be connected at its lower end to the upper end of an inner casing string (not shown) and having a shoulder 15 formed thereabout, again in a manner to be described more fully hereinafter, for landing on the seat 13 to suspend the inner casing within the outer casing.

Passageways 16 are formed in the hanger to connect at their upper and lower ends with an annular space between the hanger and bore of the housing. As indicated, these passageways permit the circulation of cement downwardly through the hanger and inner casing and upwardly into and through the annular space. Upon completion of this circulation, the annular space is closed above the passageways by means of a seal assembly SA, which may be constructed and moved into sealing position with the bore of the housing and outer diameter of the hanger in a manner shown in the aforementioned U.S. Pat. No. 4,757,860.

As previously mentioned, the housing 10 comprises a main body 17 extending its full length of the housing and a weld body 18 forming its upwardly facing seat 13. More particularly, the main body has an annular cavity 19 about its bore to receive the weld body which is formed integrally with the main body within the cavity. As will be appreciated, upon formation of the weld body in the cavity, its inner side would be finished to form the conical seat 14 intermediate the cylindrical surfaces forming continuations of the bore above and below the seat.

The hanger 14, on the other hand, comprises a main body 20 about which the passageways 16 are formed and a ring 21 which is threaded at 22 to the main body in surrounding relation to the passageways. More particularly, the ring is received in a relieved area of the main body of the hanger beneath a downwardly facing shoulder 23 to move its upper end into tight engagement with the downwardly facing shoulder 23 so that the main body is supported from the ring when the ring is landed on the seat in the bore of the housing. Thus, the load of the inner casing is transmitted through the shoulder 23 and the threads 22 to the seat 13, and from the seat 13 through the weld body to the lower end of the cavity in which it is integrally formed.

As previously mentioned, the main bodies of each of the housing and hanger are formed of a low alloy, carbon steel having a yield strength not substantially more than 75,000 psi. Each of the weld body and ring 21, on the other hand, are formed of a metal having a considerably greater yield strength, which may be in the order of 150,000 psi. More particularly, in the preferred embodiment of the invention, the cross-sectional area of the seat 13 is approximately half that of the cross-sectional area of the weld body supported by the lower end of the cavity in the main body of the housing. Also, the cross-sectional area of the load shoulder 15 on the upper end of the ring 21 is approximately one-half that of the upper end of the ring on which the shoulder 23 of the main body of the hanger is supported as well as the area of engagement of the threads 22.

As previously described, although the high yield strengths of the materials of the weld body and the ring 21 are susceptible to damage by $H_2S$, only the bore of the main body of the housing above the seal assembly and the bore of the hanger is normally exposed to $H_2S$. That is, $H_2S$ is normally encountered only at great depths within a well, and thus would enter the bore of the housing only through the bore of the hanger. Well fluids in the annular space beneath the seal assembly, and thus the area in which the high yield strength well body and load ring are located, is from a much shallower level of the well, which ordinarily would not encounter $H_2S$.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. Wellhead equipment, comprising a housing disposable at the upper end of a well and having a bore therethrough, and a tubular hanger connectible to the upper end of a pipe string and lowerable into a landed position within the bore of the housing for suspending the pipe string within the well, said housing including a main body of a first material having an internal cavity thereabout and a weld body of a second material having a considerably greater yield strength than that of the first formed integrally with the main body within the cavity to provide an upwardly facing seat in the housing bore, and said hanger including a main body of a first material and a ring of a second material having a considerably greater yield strength than that of the first material and carried by the main body in position to provide a downwardly facing shoulder engageable with the seat to support the hanger therefrom.

2. Wellhead equipment as described in claim 1, wherein the cross-sectional area of the weld body supported by the main body of the housing bears substantially the same ratio to that of the seat as does the yield strength of the weld body to that of the main body of the housing, and the cross-sectional area of the main body supported by the ring bears substantially the same ratio to that of the shoulder as does the yield strength of the ring to that of the main body.

3. Wellhead equipment as described in claim 2, wherein the ring is theadedly connected to the main body.

4. Wellhead equipment as described in claim 2, wherein the yield strengths of the main bodies of the housing and hanger are essentially equal, and the yield strengths of the weld body and ring are essentially equal.

5. Wellhead equipment as described in claim 4, wherein the first-mentioned yield strengths are in the order of 75,000 psi, and the second-mentioned yield strengths are in the order of 150,000 psi.

6. Wellhead equipment as described in claim 1, wherein passageways are formed in the main body of the hanger to connect at their upper and lower ends with an annular space between the bore of the housing and the hanger, and means are provided for closing the annular space above the ring.

7. Subsea wellhead equipment, comprising a housing adapted to be mounted on the upper end of an outer casing string and having a bore therethrough, a tubular hanger connectible to the upper end of an inner casing string and lowerable into a landed position within the bore of the housing for suspending the inner string within the outer string, said housing including a main body of a first material having an internal cavity thereabout and a weld body of a second material having a considerably greater yield strength than that of the first formed integrally with the main body within the cavity to provide an upwardly facing seat in the housing bore, said hanger including a main body of a first material and a ring of a second material having a considerably greater yield strength than that of the first material and carried by the main body in position to provide a downwardly facing shoulder engageable with the seat to support the hanger therefrom.

8. Subsea wellhead equipment as described in claim 7, wherein the cross-sectional area of the weld body supported by the main body of the housing bears substantially the same ratio to that of the seat as does the yield strength of the weld body to that of the main body of the housing, and the cross-sectional area of the main body supported by the ring bears substantially the same ratio to that of the shoulder as does the yield strength of the ring to that of the main body.

9. Subsea wellhead equipment as described in claim 8, wherein the yield strengths of the main bodies of the housing and hanger are essentially equal, and the yield strengths of the weld body and ring are essentially equal.

10. Wellhead equipment as described in claim 9, wherein the ring is theadedly connected to the main body.

11. Subsea wellhead equipment as described in claim 8, wherein the first-mentioned yield strengths are in the order of 75,000 psi, and the second-mentioned yield strengths are in the order of 150,000 psi.

12. Subsea wellhead equipment as described in claim 7, wherein passageways are formed in the main body of the hanger to connect at their upper and lower ends with an annular space between the bore of the housing and the hanger, and means are provided for closing the annular space above the ring.

* * * * *